US005208968A

United States Patent [19]

Camsell et al.

[11] Patent Number: 5,208,968

[45] Date of Patent: May 11, 1993

[54] PROGRAMMABLE INSERTION TOOL FOR A PIN HEADER

[75] Inventors: Edwin Camsell; Wolfgang E. A. Feiber; Jackie A. Kline, all of Harrisburg; Douglas C. Rubendall, Millersburg, all of Pa.

[73] Assignee: AMP Incorporated, Harrisburg, Pa.

[21] Appl. No.: 799,496

[22] Filed: Nov. 27, 1991

[51] Int. Cl.[5] ..... H01R 43/00

[52] U.S. Cl. ..... 29/739; 29/747; 29/758; 29/845; 29/884

[58] Field of Search ..... 29/739, 747, 842, 845, 29/758, 884

[56] References Cited

U.S. PATENT DOCUMENTS

| | | | |
|---|---|---|---|
| 3,216,097 | 11/1965 | Stricker et al. | 29/747 X |
| 3,785,035 | 1/1974 | Busler et al. | 29/739 |
| 3,924,325 | 12/1975 | Kufner | 29/739 X |
| 4,186,982 | 2/1980 | Cobaugh et al. | 339/17 |
| 4,394,795 | 7/1983 | Goss | 29/739 |
| 4,553,322 | 11/1985 | Cappos et al. | 29/739 |
| 4,857,018 | 8/1989 | Pickles | 439/751 |

OTHER PUBLICATIONS

AMP Instruction Sheet IS 9125 released Jul. 31, 1985 for AMP Insertion Tool 58198.

*Primary Examiner*—Carl E. Hall

*Attorney, Agent, or Firm*—James M. Trygg; Robert J. Kapalka

[57] ABSTRACT

A programmable insertion tool is provided for inserting the contact pins of a pin header connector into plated through holes in a printed circuit board. The tool utilizes push pins of differing lengths to position selected contact pins to selected different depths thereby providing a make first, break last capability for these contact pins when connecting or disconnecting to a mating connector half.

8 Claims, 4 Drawing Sheets

PROGRAMMABLE INSERTION TOOL FOR A PIN HEADER

The present invention relates to a tool for inserting the contact pins of a connector into openings in a printed circuit board wherein the pins are of differing heights above the surface of the board to provide make first, break last capability for selected contact pins.

This patent application is related to U.S. patent application Ser. No. 07/799,495 filed concurrently herewith, now U.S. Pat. No. 5,142,777, and which is assigned to the present assignee.

BACKGROUND OF THE INVENTION

With the use of integrated circuits and other similar sensitive electronic components with protective networks, steps must be taken to prevent exposure of these sensitive elements to extraneous static charges during installation and removal of interface connections. Elaborate schemes have been developed to assure such protection by grounding all potential carriers of a static charge including the worker who is assembling or repairing the electronic equipment. Such static charges are typically 4 to 30 kilovolts and if permitted to discharge through a microprocessor chip, could cause substantial damage. To solve this problem, connectors have been developed whereby selected contacts, typically ground and power contacts, mate prior to the mating of the signal contacts. This is accomplished by making the ground and power pins longer than the other pins so that they mate first. This assures that any static charge that is on the connector being mated to the electronic equipment will be discharged through ground rather than through the signal pins. Another advantage of such a structure is that by applying ground and power first, signal levels within the circuitry are permitted to stabilize prior to connection of the signal leads, thereby preventing transients on the data pins.

To manufacture connectors having certain pins longer than the others, however, requires a special process involving pins of two different lengths. Because users of such connectors often have differing needs, the manufacturer of the connector must make a variety of connectors, all being similar except as to which pins are longer. This results in higher manufacturing costs for these connectors, and should a user change his design he may have an inventory of connectors of the old design that is now of no use.

What is needed is an apparatus and method for inserting the pins of single standardized pin header connector that can be programmed to insert standard length pins so that selected pins mate prior to the other pins of the connector.

SUMMARY OF THE INVENTION

The present invention is a programmable insertion tool for inserting a plurality of pins of a connector into openings in a substrate. A first of these pins is inserted into its respective opening to a selected depth less than that of a second of these pins. The tool includes a body and a pusher means within the body for individually engaging each of the pins. When the body is urged toward the substrate each of the pins is inserted into its respective opening and the first and second pins are inserted to their respective selected depths.

DESCRIPTION OF THE PREFERRED EMBODIMENT

Figure 1:
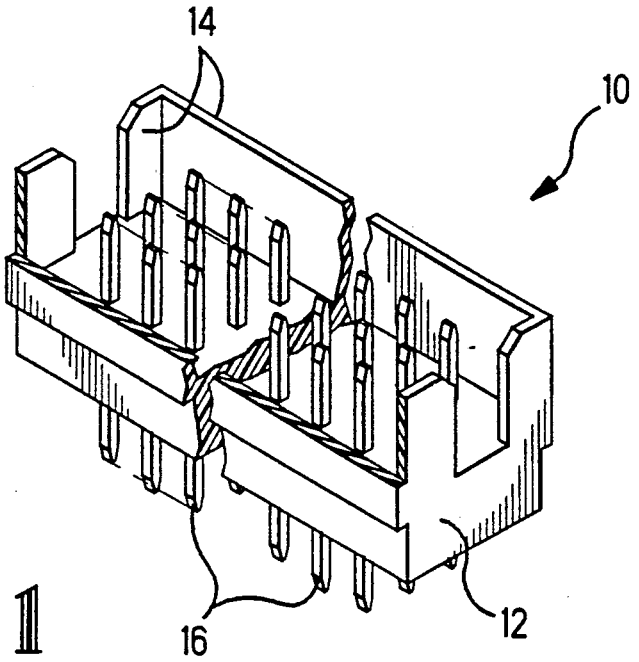
FIG. 1 is an isometric view of a pin header connector.
Figure 2:
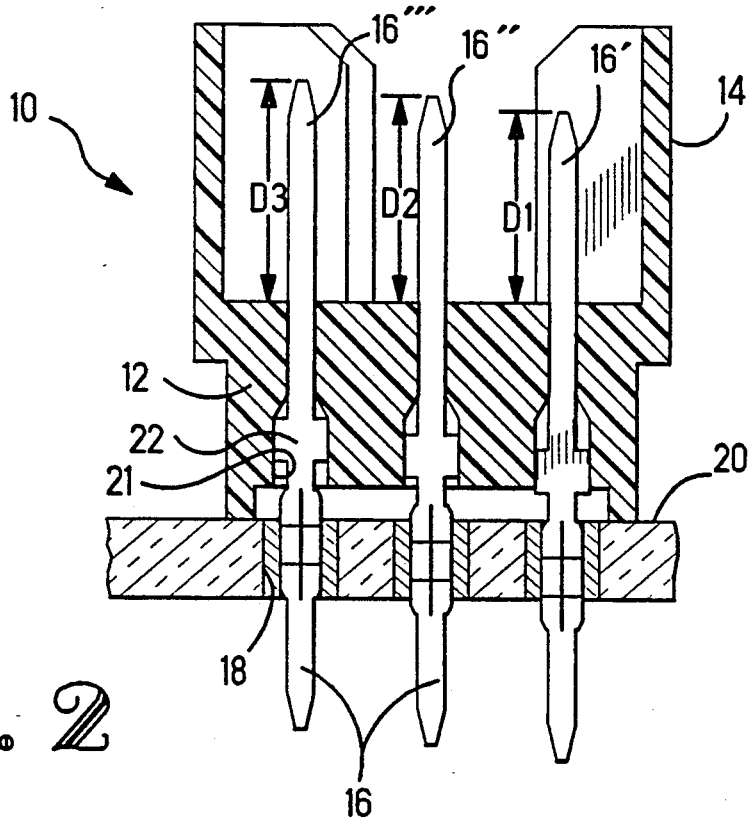
FIG. 2 is a cross-sectional view of the connector of FIG. 1 shown assembled to a printed circuit board in accordance with the teachings of the present invention.

A pin header connector 10, shown in FIGS. 1 and 2, includes an insulating housing 12 having a shroud 14 and a plurality of contact pins 16 disposed therein. As best seen in FIG. 2, the connector 10 is assembled to a printed circuit board 20 by means of the pins 16 being forced into interference fit holes 18 disposed in the board. Each of the pins 16 is retained in a cavity 21 by means of barbs 22 formed on the pin and which are in interference fit with the cavity in the usual manner. As is shown in FIG. 2, the pin 16' is inserted to a depth of D1, the pin 16'' to a depth of D2, and the pin 16''' to a depth of D3, D3 being greater than D2 and D2 being greater than D1. This structure would, for example, allow ground to be connected to pin 16''', power connected to pin 16'', and signal connected to pin 16'. Then when connecting and disconnecting the mating half of the connector, not shown, ground would make first and break last, power would make and break second, and signal would make last and break first. It will be understood that this particular structure shown in FIG. 2 is illustrative only and that various other structural arrangements may advantageously utilize the teachings of the present invention.

Figure 3:
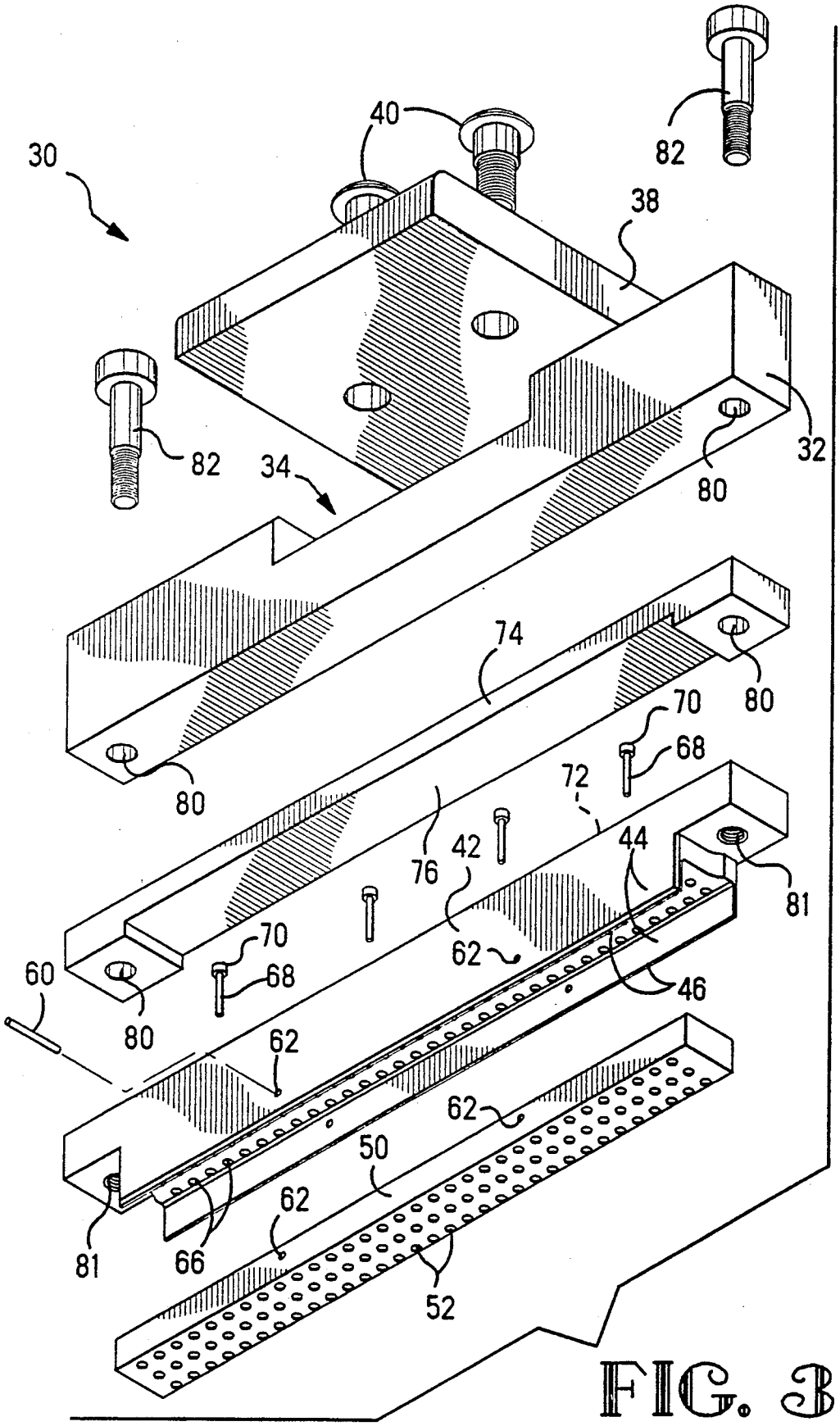
FIG. 3 is an exploded parts view of a tool in accordance with the teachings of the present invention.
Figure 4:
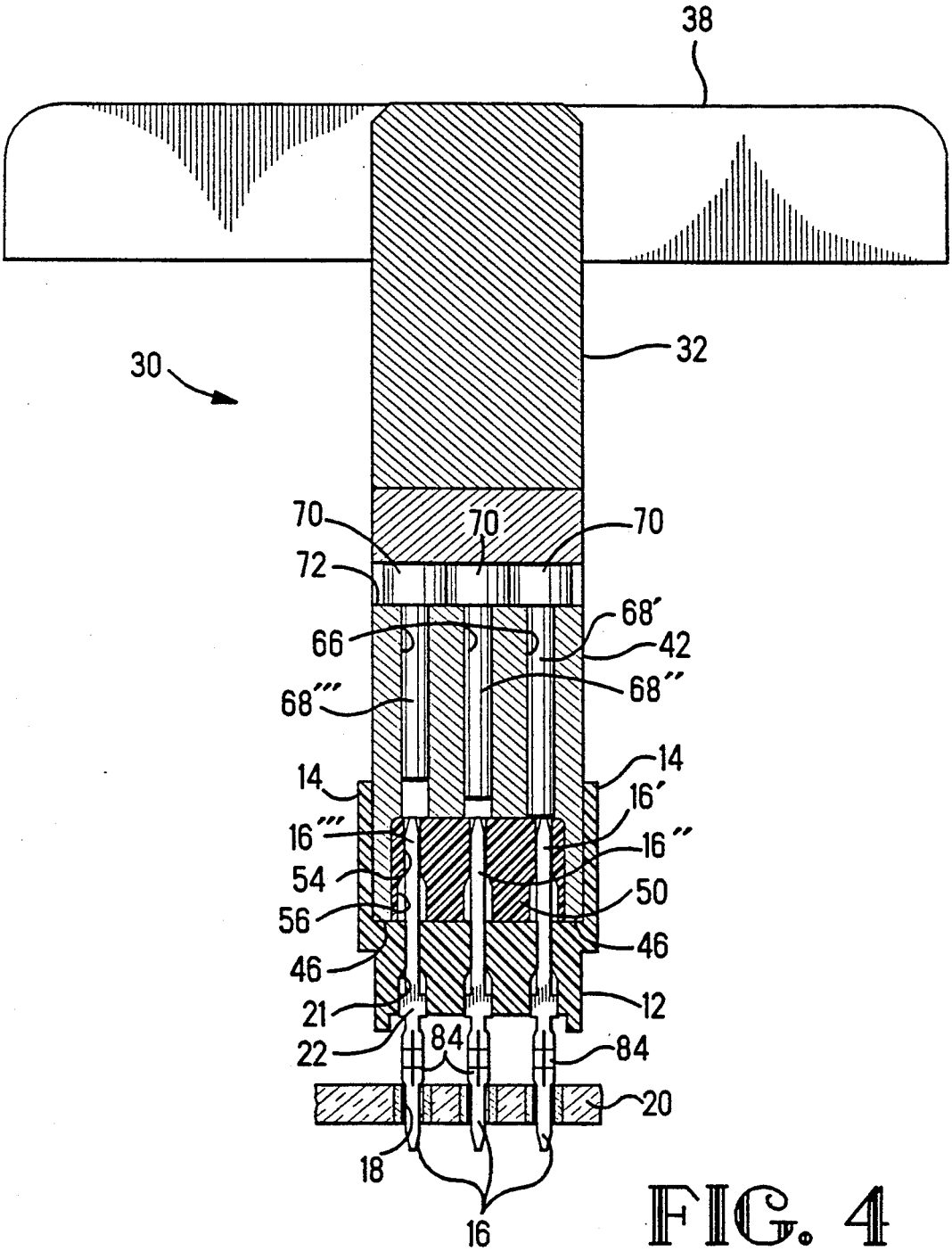
FIG. 4 is a cross-sectional view showing the tool of FIG. 3 and connector of FIG. 2 partially seated in the printed circuit board.
Figure 5:
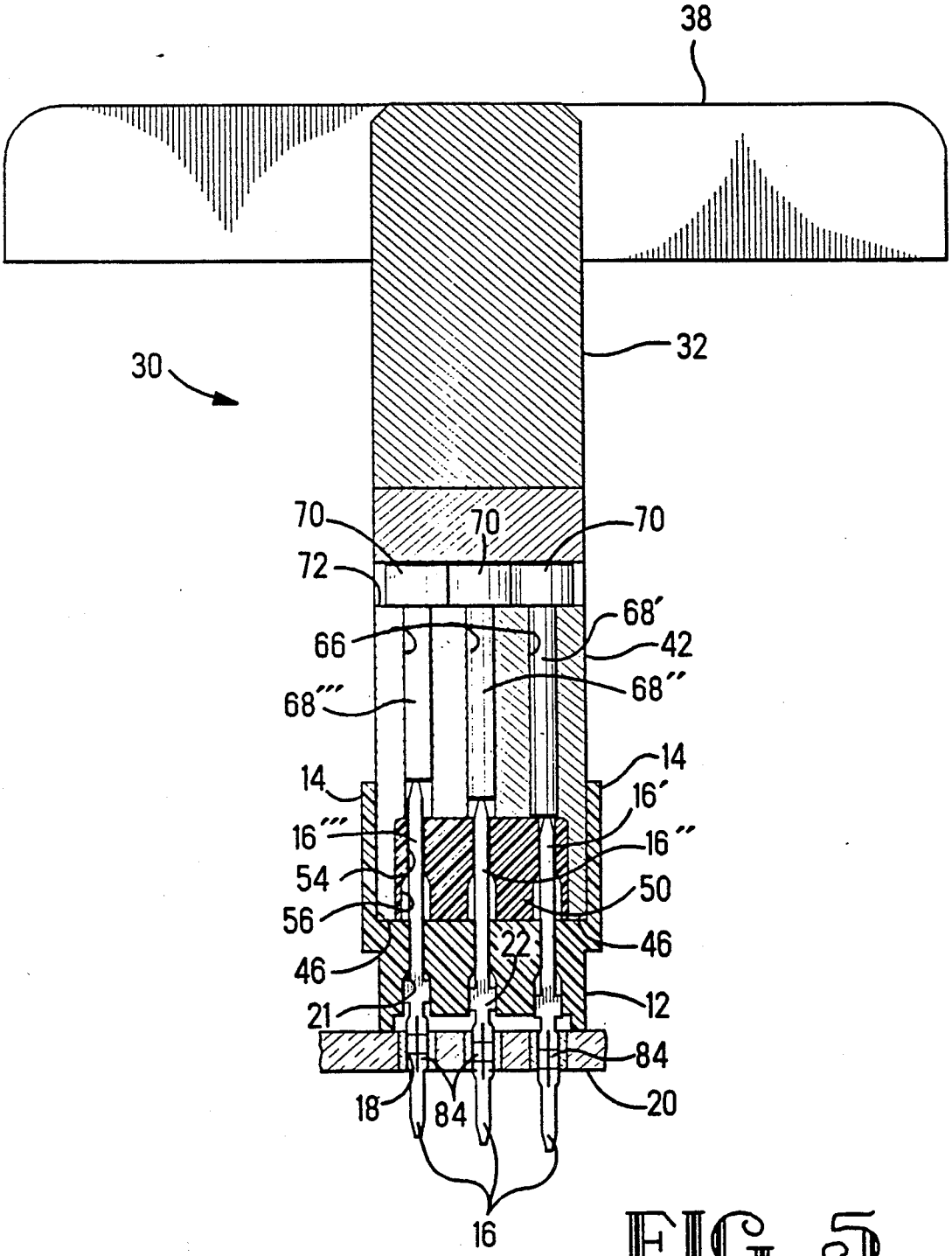
FIG. 5 is a view similar to that of FIG. 4 showing the connector fully seated in the printed circuit board.

To achieve proper insertion of the pins 16', 16'', and 16''' to their respective selected depths of D1, D2, and D3 an insertion tool 30, as shown in FIGS. 3, 4, and 5, is utilized. The tool 30 includes a backing bar 32, having a cutout 34 formed in one surface thereof. A stabilizer plate 38 sized to fit within the cutout 34 is securely attached to the backing bar 32 by means of the screw fasteners 40. A body member 42 includes a pair of extended side members 44 which are spaced to fit between the walls of the shroud 14, as best seen in FIGS. 4 and 5, so that the lower edges 46 abuttingly engage the connector housing 12 as shown. A pin support plate 50 is sized to fit within the extended side members 44 and includes a plurality of through holes 52 spaced in one to one correspondence to and in registry with the pins 16 of the pin header connector 10. The holes 52 include a pin supporting portion 54 and an enlarged lead-in portion 56 for more easily guiding the pins 16 into the holes 52 when assembling the tool 30 to the connector 12 preparatory to insertion of the pins 16 into the printed circuit board 20. In the present example, the pin support plate 50 is made of a relatively stable plastic such as Valox 420 SEO, manufactured by General Electric Co., One Lexon Lane, Mount Vernon, Indiana 47620-9364, however, any suitable stable material may be used. The pin support plate 50 is retained within the extended side members 44 by means of a pair of roll pins 60 which are pressed into holes 62 formed through the side members 44 and the plate 50.

The body member 42 includes a plurality of holes 66 formed therethrough in precise alignment with the holes 52 of the pin support plate 50 so that each hole 52 is in registry with a corresponding hole 66. A cylindrical shaped pusher pin 68 having a diameter that is a slip fit with the hole 66 is disposed in each hole 66, as shown in FIGS. 4 and 5. Each pin 68 includes an enlarged head 70 which rests on a top surface 72 of the body member 42. A backup bar 74 includes a cutout 72 having a depth substantially equal to the height of the enlarged head 70. With the backup bar 74 arranged in position against the surface 72 of the body member 42, the pusher pins 68 are held captive within their holes 66 as shown in FIGS. 4 and 5. A pair of clearance holes 80 are formed in the ends of both the backing bar 32 and the backup bar 74 in alignment with a pair of threaded holes 81 formed in the body member 42 near each end. The complete assembly is secured together by means of the screws 82. The pusher pins 68 are provided in three different lengths corresponding to the three different depths D1, D2, and D3 of insertion that is required of the contact pins 16. A pusher pin 68 of any of the three different lengths may be placed in any of the holes 66 so that a desired combination of different depths of the contact pins 16 may be achieved. In the present example, as shown in FIGS. 4 and 5, the longest pusher pin 68' is in a hole 66 in alignment with the contact pin 16', the pusher pin 68'' in alignment with the contact pin 16'', and the pusher pin 68''' in alignment with the contact pin 16'''.

In operation, the pin header connector 12 is positioned on the printed circuit board 20 with the tails of the contact pins 16 partially inserted into their respective openings 18, as shown in FIG. 4. The tool 30 is then aligned with and inserted into the space within the shroud 14 so that the contact ends of the contact pins 16 enter their respective holes 52 in the support plate 50 as shown. The complete assembly, the tool 30, connector 12, and printed circuit board 20 are then positioned in a press, not shown, such as an arbor press, and the ram of the press caused to bear against the stabilizer plate 38 thereby urging the tool and connector toward the board 20. The edges 46 of the side extensions 44 engage the connector housing 12 urging it toward the board 20. As the press fit portions 84 of the pins 16 engage their respective holes 18 in the board 20, the opposite ends of each of the pins 16 either engages and abuts its respective pusher pin 68, as in the case of the contact pin 16' and the pusher pin 68', or as in the case of the contact pins 16'' and 16''', remains stationary with respect to the board 20. As the ram motion continues, the pusher pin 68' causes the press fit portion 84 of the contact pin 16' to enter its respective hole 18 with the housing 12 moving toward the board 20 while the barbs 22 of the contact pins 16'' and 16''' move deeper into their respective cavities 21, as shown in FIG. 2. As downward motion of the ram continues, the pusher pin 68'' engages the end of the contact pin 16'' causing its press fit portion 84 to enter its hole 18, and finally the pusher pin 68''' engages the end of the contact pin 16''' causing its press fit portion 84 to enter its hole 18. When the connector housing 12 has fully engaged the board 20, as shown in FIG. 5, the ram is withdrawn and the tool 30 removed from the connector 10 resulting in the pins 16', 16'' and 16''' having the insertion depths of D1, D2, and D3 respectively as best seen in FIG. 2.

An important advantage of the present invention is that the tool may be quickly programmed to insert contact pins in any combination of the two or three different depths provided. This permits the user to stock only one standard version of the connector 10 independent of the required insertion depth configuration thereby saving substantial design time, manufacturing and inventory costs.

What is claimed is:

1. A programmable insertion tool for inserting a plurality of contact pins of a connector into respective openings in a substrate, said tool comprising:

(a) a body; and, (b) a plurality of elongated members arranged within openings in said body, each of said elongated members being in axial alignment with a respective one of said contact pins and having an end in abutting engagement with said respective one contact pin during said inserting, each elongated member disposed at a selected distance from said substrate for engaging corresponding ones of said plurality of contact pins, said plurality of elongated members including at least first and second elongated members disposed at selected different relative distances from said substrate and engaging first and second ones of said contact pins, respectively, such that when said body is urged toward said substrate, each of said plurality of contact pins is inserted to a selected depth in its respective said opening, said selected depth corresponding to said selected distance of a respective said elongated member from said substrate, and the first contact pin is inserted to a first depth different from a depth of the second contact pin.

2. The tool according to claim 1 wherein each of said elongated members has an axial length that corresponds to the selected depth of its said respective one contact pin.

3. The tool according to claim 2 wherein each of said elongated members has an opposite end defining an enlarged head in abutting engagement with a surface of said body during said inserting.

4. The tool according to claim 2 wherein each of said elongated members is of cylindrical shape and each of said openings is a round hole formed in said body.

5. The tool according to claim 2 further including pin support means for providing structural support of each of said plurality of contact pins against bending thereof during said inserting.

6. The tool according to claim 5 wherein said pin support means comprises a block of rectangular cross section having two oppositely formed substantially parallel surfaces, said block including a plurality of holes therethrough normal to and intersecting both of said parallel surfaces and spaced and sized to closely receive each of said plurality of contact pins.

7. The tool according to claim 6 wherein said body includes a cavity for receiving and holding said block in a position so that each of said holes of said block is in substantial registry with the longitudinal axis of a respective one of said plurality of elongated members.

8. The tool according to claim 3 wherein said body is composed of a body member containing said plurality of elongated members and a backup bar attached thereto, wherein said enlarged heads of said elongated members are in said abutting engagement with a surface of said backup bar.

* * * * *